United States Patent [19]

Schank

[11] Patent Number: 4,923,775

[45] Date of Patent: May 8, 1990

[54] PHOTORECEPTOR OVERCOATED WITH A POLYSILOXANE

[75] Inventor: Richard L. Schank, Pittsford, N.Y.

[73] Assignee: Xerox Corporation, Stamford, Conn.

[21] Appl. No.: 288,841

[22] Filed: Dec. 23, 1988

[51] Int. Cl.[5] ..... G03G 5/14

[52] U.S. Cl. ..... 430/59; 430/66

[58] Field of Search ..... 430/66, 67, 96, 59

[56] References Cited

U.S. PATENT DOCUMENTS

| | | | |
|---|---|---|---|
| 4,439,509 | 3/1984 | Schank | 430/132 |
| 4,595,602 | 6/1986 | Schank | 427/76 |
| 4,600,673 | 7/1986 | Hendrickson et al. | 430/66 |
| 4,606,934 | 8/1986 | Lee et al. | 427/76 |
| 4,716,091 | 12/1987 | Yoshihara et al. | 430/66 |

FOREIGN PATENT DOCUMENTS

| | | |
|---|---|---|
| 4001631 | 1/1979 | Japan . |
| 4005731 | 1/1979 | Japan . |
| 8060747 | 4/1983 | Japan . |
| 8088753 | 5/1983 | Japan . |
| 57-17518 | 8/1983 | Japan . |
| 8152255A | 9/1983 | Japan . |

*Primary Examiner*—John L. Goodrow

[57] ABSTRACT

An electrophotographic imaging member comprising a supporting substrate, at least one photoconductive layer and an overcoating layer comprising a polymerized silane, the polymerized silane comprising compounds containing electron accepting atoms or moieties attached to silicon atoms.

14 Claims, No Drawings

PHOTORECEPTOR OVERCOATED WITH A POLYSILOXANE

BACKGROUND OF THE INVENTION

This invention relates to overcoated electrophotographic imaging members and more particularly, to electrophotographic imaging members overcoated with a solid reaction product of a polymerized silane compound comprising an electron accepting group attached to silicon.

The formation and development of electrostatic latent images utilizing electrophotographic imaging members is well known. One of the most widely used processes being xerography as described by Carlson in U.S. Pat. No. 2,297,691. In this process, an electrostatic latent image formed on an electrophotographic imaging member is developed by applying electropscopic toner particles thereto to form a visible toner image corresponding to the electrostatic latent image. Development may be effected by numerous known techniques including cascade development, powder cloud development, magnetic brush development, liquid development and the like. The deposited toner image is normally transferred to a receiving member such as paper.

Electrophotographic imaging systems may utilize single multilayered organic or inorganic photoresponsive devices. In one photoresponsive device, a substrate is overcoated with a hole injecting layer and a hole transport layer. These devices have been found to be very useful in imaging systems. The details of this type of overcoated photoreceptor are fully disclosed, for example, in U.S. Pat. No. 4,265,990. The entire disclosure of this patent is incorporated herein by reference. If desired, multilayered photoresponsive devices may be overcoated with a protective layer. Other photoreceptors that may utilize protective overcoatings include inorganic photoreceptors such as the selenium alloy photoreceptors, disclosed in U.S. Pat. No. 3,312,548, the entire disclosure of which is incorporated herein by reference.

When utilizing such an organic or inorganic photoresponsive device in different imaging systems, various environmental conditions detrimental to the performance and life of the photoreceptor from both a physical and chemical contamination viewpoint can be encountered. For example, organic amines, mercury vapor, human fingerprints, high temperatures and the like can cause crystallization of amorphous selenium photoreceptors thereby resulting in undesirable copy quality and image delection. Further, physical damage such as scratches on both organic and inorganic photoresponsive devices can result in unwanted printout on the final copy. In addition, organic photoresponsive devices sensitive to oxidation amplified by electric charging devices can experience reduced useful life in a machine environment. Also, with certain overcoated organic photoreceptors, difficulties have been encountered with regard to the formation and transfer of developed toner images. For example, toner materials often do not release sufficiently from a photoresponsive surface during transfer or cleaning thereby forming unwanted residual toner particles thereon. These unwanted toner particles are subsequently embedded into or transferred from the imaging surface in subsequent imaging steps, thereby resulting in undesirable images of low quality and/or high background. In some instances, the dry toner particles also adhere to the imaging member and cause printout of background areas due to the adhesive attraction of the toner particles to the photoreceptors surface. This can be particularly troublesome when elastomeric polymers or resins are employed as photoreceptor overcoatings. For example, low molecular weight silicone components in protective overcoatings can migrate to the outer surface of the overcoating and act as an adhesive for dry toner particles brought into contact therewith in the background areas of the photoreceptor during xerographic development. These toner deposits result in high background prints.

INFORMATION DISCLOSURE STATEMENT

In U.S. Pat. No. 4,595,602 issued to Schank on 6/17/86, a process for forming an overcoated electrophotographic imaging member is disclosed comprising applying on an electrophotographic imaging member a coating in liquid form comprising a cross-linkable siloxanol-colloidal silica hybrid material having at least one silicon bonded hydroxyl group per every three —SiO— units on the electrophotographic imaging member and a hydrolyzed ammonium salt of an alkoxy silane and curing the cross-linkable siloxanol-colloidal silica hybrid material until the siloxanol-colloidal silica hybrid material reacts with the hydrolyzed ammonium salt to form a hard cross-linked solid organosiloxane-silica hybrid polymer layer.

In U.S. Pat. No. 4,606,934 issued to Lee et al on 8/19/86, a process for forming an overcoated electrophotographic imaging member is disclosed comprising applying on an electrophotographic imaging member a coating in liquid form comprising a cross-linkable siloxanol-colloidal silica hybrid material having at least one silicon bonded hydroxyl group per every three —SiO— units and a catalyst for the cross-linkable siloxanol-colloidal silica hybrid material, the coating in liquid form having an acid number of less than about 1 and curing the on the electrophotographic imaging member and a hydrolyzed ammonium salt of an alkoxy silane and curing the cross-linkable siloxanol-colloidal silica hybrid material with an ammonia catalyst until the siloxanol-colloidal silica hybrid material unit it forms a hard cross-linked solid organosiloxane-silica hybrid polymer layer.

In U.S. Pat. No. 4,439,509 issued to Schank issued on 6/17/86—a process for preparing an electrophotographic overcoat for an imaging member is disclosed in which the overcoat comprises siloxanol-colloidal silica hybrid material. The reference further discloses that the overcoat is prepared by hydrolyzing organosilanes and the silanes are stabilized with colloidal silica.

In Japanese Patent Document No. J54-005731 published 1/17/79—an electrophotographic photoreceptor having a protective layer formed by a silicone compound comprising silane coupling agents is disclosed. The reference further discloses the silane compounds may contain vinyl or amino alkyl groups.

In Japanese Patent Document No. J58-088753A published 5/26/83—an electrophotographic photoreceptor is disclosed comprising a carbon-added a silicon compound yielding improved surface potential accepting capacity.

In Japanese Patent Document No. J58-152255A published 9/9/83—a photoconductor comprising an amorphous silicon nitride insulating layer is disclosed. The document further discloses that silane gas is used in the formation of the silicon nitride and that the insulating layer is sufficiently thick to reduce residual potential without lowering the performance of a photoconductor.

In Japanese Patent Document No. J57-17518 published 8/12/83—an electrophotographic receptor with a photoconductive layer made of amorphous silicon containing hydrogen is disclosed. The document further discloses an electrophotographic receptor with high sensitivity and improved acceptance voltage.

In Japanese Patent Document No. J58-060747 published 4/11/83—an electrophotographic sensitizing material is disclosed with a protective layer containing silicon and germanium. The document further discloses that silane gas is used to deposit the protecting layer onto the photosensitive layer and that the material has a high mechanical friction resistance.

In Japanese Patent Document No. J54-001631 published 1/8/79—an electrosensitive material is disclosed having an insulating layer comprising a silicon compound and a hardenable resin. The hardenable resin contains acetoxysilane.

When highly electrically insulating polysiloxane resin protective overcoatings are used on photoreceptors, the thickness of the overcoatings are limited to extremely thin layers due to the undesirable residual voltage cycle up. Thin overcoatings provide less protection against abrasion and therefore fail to extend photoreceptor life for any significant period. Conductive overcoating components permit thicker coatings but can cause fluctuations in electrical properties with change in ambient humidity and also contribute to lateral conduction with a resulting reduction in image resolution. Moreover, under cycling conditions over an extended period of time at elevated temperatures and high relative humidity, such silicone overcoated photoreceptors containing a conductive overcoating component can cause deletions in the images of final copies.

SUMMARY OF THE INVENTION

It is a feature of the present invention to provide improved overcoated electrophotograhic imaging members which overcome many of the above noted disadvantages.

A further feature of the present invention is to provide a cured silicone overcoating for electrophotographic imaging members which does not degrade images under cycling conditions over an extended period of time at low or elevated temperatures.

It is another feature of the present invention to provide a cured silicone overcoating for electrophotographic imaging members which does not degrade images under cycling conditions over an extended period of time at low or high relative humidity.

It is still another feature of the present invention to provide an overcoating which achieves excellent release and transfer of toner particles from an electrophotographic imaging member.

It is another feature of the present invention to provide an overcoating which extends the useful life of electrophotographic imaging members.

It is further feature of the present invention to provide an overcoating which controls residual voltage build up and any resulting print background.

These and other features of the present invention are accomplished by providing an electrophtographic imaging member comprising a supporting substrate, at least one photoconductive layer and an overcoating layer comprising a polymerized silane, said polymerized silane comprising compounds having an electron accepting atom or moiety attached to silicon.

Any suitable polymerizable silane comprising compounds having an electron accepting atom or moiety attached to silicon may be employed. The expression "electron accepting" is defined as those atoms or moieties, because of their more electronegative nature, attract electrons from electron donating sources.

Generally, polymerization of silanes is effected by hydrolysis and condensation of silanes. Typical polymerizable silanes include methyltrimethoxsilane, methyltriethoxysilane, vinyltrimethoxysilane, vinyltriethoxysilane, phenyltriethoxysilane, ethyltriethoxysilane, butyltrimethoxysilane, triethoxysilane, trimethoxysilane, and the like and mixtures thereof.

Examples of cross-linkable siloxanol-colloidal silica hybrid materials that are useful for forming polymerized silanes of the present invention are essentially the same as those materials commerically available from Dow Corning, such as Vestar Q9-6503, from SDC Coatings, such as Silvue Arc, and from General Electric such as SHC-1000 and SHC-1010 except that the cross-linkable siloxanol-colloidal silica hybrid material compositions are substantially free of ionic components such as acids, metal salts of organic and inorganic acids and the like. Cross-linkable siloxanol-colloidal silica hybrid material having an acid number of less than about 1 is available from Dow Corning Co. and SDC coatings. The expression "substantially free of ionic components" is defined as having an acid number of less than about 1. Determination of acid number may be accomplished by any suitable conventional technique such as by titrating the cross-linkable siloxanol-colloidal silica hybrid solution with an alcoholic KOH solution at 0.1N. When Bromocresole Purple is used as an indicator, the color is yellow at a pH of 5.2. The endpoint of the titration is pH 6.4 at which point the color of the soluton changes to purple. The acid number is calculated as:

$$\frac{\text{Volume}^{(ml)}_{(KOH)} \times \text{Concentration}_{(KOH)}}{\text{Sample Weight in Grams}}$$

These cross-linkable siloxanol-colloidal silica hybrid materials have been characterized as a dispersion of colloidal silica and a partial condensate of a silanol in an alcohol-water medium.

These cross-linkable siloxanol-colloidal silica hybrid materials are believed to be prepared from trifunctional polymerizable silanes preferably having the structural formula:

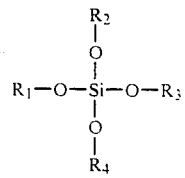

wherein $R_1$ is an alkyl or allene group having 1 to 8 carbon atoms, and $R_2$, $R_3$, and $R_4$ are independently selected from the group consisting of methyl and ethyl.

The —OR groups of the trifunctional polymerizable silane are hydrolyzed with water and the hydrolyzed material is stabilized with colloidal silica, alcohol, and a minimal amount of acid whereby the acid number of the resulting mixture is less than about 1. At least some of the alcohol may be provided from the hydrolysis of the alkoxy groups of the silane. The stabilized material is partially polymerized as a pre-polymer prior to application as a coating on an electrophotographic imaging member. The degree of polymerization should be sufficiently low with sufficient silicon bonded hydroxyl groups so that the organosiloxane pre-polymer may be applied in liquid form with or without a solvent to the electrophotographic imaging member. Generally, this prepolymer can be characterized as a siloxanol polymer having at least one silicon-bonded hydroxyl group per every three —SiO— units. Typical trifunctional polymerizable silanes include methyl triethoxysilane, methyl trimethoxysilane, vinyl triethoxysilane, vinyl trimethoxysilane, butyl triethoxysilane, propyl trimethoxysilane, phenyl triethoxysilane and the like. If desired, mixtures of trifunctional silanes may be employed to form the cross-linkable siloxanol-colloidal silica hybrd. Methyl trialkoxysilanes are preferred because polymerized coatings formed therefrom are more durable and are more abhesive to toner particles.

The silica component of the coating mixture is present as colloidal silica. The colloidal silica is available in aqueous dispersions in which the particle size is between about 5 and about 150 millimicrometers in diameter. Colloidal silica particles having an average particle size between about 10 and about 30 millimicrometers provide coatings with the greatest stability. An example of a method of preparing the cross-linkable siloxanol-colloidal silica hybrid material is described in U.S. Pat. Nos. 3,986,997, 4,027,073, and 4,439,509, the entire disclosure of each patent being incorporated by reference herein. However, unlike the method described in U.S. Pat. Nos. 3,986,997, 4,027,073, and 4,439,509, no acid is utilized during preparation of the cross-linkable siloxanol-colloidal silica hybrid material to achieve an acid number of less than about 1 which is mainly due to the silanol groups. The use of no acid increases the preparation time but reduces the amount of ionic contaminants in the final cured coating. The dispersion was filtered through a 1-micron filter to remove large silica particles. No stabilizer is added to prevent any gellation or setting at room temperature.

Since a cross-linkable siloxanol-colloidal silica hybrid material having a low acid number tends to form microgels and come out of dispersion at room temperature, it must be refrigerated during storage. For example, a dispersion of a cross-linkable siloxanol-colloidal silica hybrid material having a low acid number will normally be lost due to the formation of microgels after several months at a storage temperature of −9° C. Generally, storage at a freezer temperature of at less than about −20° C. is preferred to ensure avoidance of premature loss of the cross-linkable siloxanol-colloidal silica hybrid material dispersion prior to coating.

Since low molecular weight non-reactive oils are generally undesirable in the final overcoating, any such non-reactive oils should be removed prior to application to the electrophotographic imaging member. For example, linear polysiloxane oils tend to leach to the surface of solidified overcoatings and cause undesirable toner adhesion. Any suitable technique such as distillation may be employed to remove the undesirable impurities. However, if the starting monomers are pure, non-reactive oils are not present in the coating.

Any suitable electron accepting atom or moiety may be attached to the silicon atoms of the polymerized silane. The electron accepting group is attached to an organic segment which is in turn attached to Si by the Si—C bond. These segments are found in materials commercially available from companies such as Dow-Corning Corp., General Electric Co., and Petrarch Systems, Inc. A typical structure containing the electron accepting group attached to an organic segment which in turn is attached to Si by the Si—C bond is represented by the following formula:

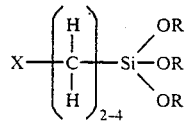

wherein

R is an alkyl group having from 1 to 14 carbon atoms and

X is an electron accepting atom or an electron attracting moiety.

Typical electron attracting atoms include chlorine, bromine, iodine, fluorine, and the like. Typical electron attracting moieties attached to silicon atoms through carbon include nitrile, nitro, and the like. Attachment to silicon atoms of electron attracting moieties may be by means of carbon in the form of alkyl groups containing from 1 to 4 carbon atoms, phenyl groups, and the like. Typical moieties include cyanoethyl, chloromethyl, chloropropyl, chlorophenyl, cyanopropyl, and the like and mixtures thereof. Typical silanes containing electron attracting atoms or moieties that may be polymerized to form polymerized silanes include chloromethyltriethoxysilane, chlorophenyltriethyoxysilane, 2-cyanoethyltriethoxysilane, 3-chloropropyltriethoxysilane, chloromethylmethyldiethoxysilane, cyanopropyltriethoxysilane, cyanoethyltrimethoxysilane, cyanopropyltrimethoxysilane, and the like and mixtures thereof.

Generally, satisfactory results may be obtained when the overcoating mixture contains about 20 to about 90 weight percent electron accepting segments. About 40 to about 70 weight percent electron accepting segments is usually preferred to maintain acceptable electric properties. Also, the desirable physical proportions of the polymerized silane material may be adversely affected by higher concentrations of such electron accepting segments. The concentrations of each particular electron accepting segment should be optimized individually for both physical and electrical behavior of the overcoated film on the photoreceptor.

By incorporating these electron accepting groups with a cross-linkable siloxanol-colloidal silica hybrid material, the electrical conductivity of the resulting films can be modified so that satisfactory control of the electrical properties of these overcoats can be achieved over an extended relative humidity range of from about 10 percent to about 90 percent. Moreover, the overcoatings of this invention permit protective coatings to be used thereby extending the useful life of the photoreceptor.

By chemically linking the electron accepting groups to the silicon atoms of a cross-linked siloxanol-colloidal silica hybrid matrix material, the electron accepting groups are uniformly distributed throughout the overcoating and permanently anchored in place thereby providing sufficient and stable electrical conductivity characteristics to the overcoating under a wide range of temperature and humidity conditions.

More amounts of resins may be added to the coating mixture to enhance the electrical or physical properties of the overcoating. Examples of typical resins include polyurethanes, nylons, polyesters, and the like. Satisfactory results may be achieved when up to about 5 to 30 parts by weight of resin based on the total weight of the total coating mixture is added to the coating mixture prior to application to the electrophotographic imaging member.

Minor amounts of plasticizers may also be added to the coating mixture to enhance the physical properties of the the overcoating, particularly when thick coatings are formed. Examples of typical plasticizers include hydroxy terminated polydimethylsiloxane, nylon (e.g. Elvamide 8061 and Elvamide 8064, available from E. I. du Pont de Nemours & Co.) and the like. Satisfactory results may be achieved when up to about 1 to 10 parts by weight of plasticizer based on the weight of the cross-linkable siloxanol-colloidal silica hybrid material is added to the coating mixture prior to application to the electrophotographic imaging member. A hydroxyl terminated polydimethylsiloxane plasticizer is preferred because it chemically reacts with the cross-linkable siloxanol-colloidal silica hybrid material when used and cannot leach to the surface of solidified overcoatings and cause undesirable toner adhesion to the top surface and/or adhesive failure to the photoreceptor interface surface.

The cross-linkable siloxanol-colloidal silica hybrid material of the present invention containing the electron accepting groups attached to silicon atoms is applied to electrophotographic members as a thin coating having a thickness after cross-linking of from about 0.3 micrometer to about 5 micrometers. If the coating thickness is increased above about 5 micrometers, lateral conductivity may be encountered causing deletion or defocused image problems. Thicknesses less than about 0.3 micrometer are difficult to apply but may probably be applied with the spraying techniques. Generally speaking, a thicker coating tends to wear better. Moreover, deeper scratches are tolerated with thicker coatings because the scratches do not print out as long as the surface of the electrophotographic imaging member itself is not contacted by the means causing the scratch. A cross-linked coating having a thickness from about 0.5 micron to about 3 micrometers is preferred from the viewpoint of optimizing electrical, transfer, cleaning and scratch resistance properties. These coatings also protect the photoreceptor from varying atmospheric conditions and can even tolerate contact with human hands.

Although minute amounts of ionic condensation catalysts may be tolerated to cure or assist in curing the cross-linkable siloxanol-colloidal silica hybrid material so long as the acid number of the coating mixture is maintained below about 1, catalysts free of ionic components are preferred for curing the cross-linkable siloxanol-colloidal silica hybrid material because print deletion at high temperatures and high relative humidity is minimized or totally obviated. Typical condensation catalysts include gamma aminopropyltriethoxysilane, N-(2-aminoethyl)-3-aminopropyltrimethoxysilane, anhydrous ammonia vapor, and the like.

The condensation catalyst is normally incorporated into the coating mixture containing the cross-linkable siloxanol-colloidal silica hybrid material prior to applying the coating mixture to the electrophotographic imaging member. If desired, the condensation catalyst may be ommited from the coating mixture. If a condensation catalyst is employed, the amount added to the coating mixture is normally less than about 10 percent by weight based on the weight of the cross-linkable siloxanol-colloidal silica hybrid material.

Selection of curing temperatures to cross-link the siloxanol-colloidal silica hybrid material depends upon the amount and type of catalyst employed as well as the thermal stability of the photoreceptor which has been overcoated. Generally, satisfactory curing may be achieved at curing tempertures between about 30° C. and about 100° C. when using a catalyst and temperatures between about 100° c. and about 140° C. when a catalyst is not employed. Curing time varies with the amount and type of catalyst employed as well as the temperature used. During curing of the cross-linkable siloxanol, i.e. partial condensate of a silanol, the residual hydroxyl groups condense to form a silsesquioxane, $RSiO_{3/2}$. When the overcoating is adequately cross-linked, it forms a hard, solid coating which is not dissolved by isopropyl alcohol. The cross-linked coating is exceptionally hard and resists scratching by a sharpened 5H or 6H pencil.

The cross-linkable siloxanol-colloidal silica hybrid material containing the electron accepting groups attached to hydrolyzed alkoxy silanes may be applied to the electrophotographic imaging member by any suitable technique. Typical coating techniques include blade coating, dip coating, roll coating, flow coating, spraying and draw bar application processes. Any suitable solvent or solvent mixture may be utilized to facilitate forming the desired coating film thickness. Alcohols such as methanol, ethanol, propanol, isopropanol, butanol, isobutanol and the like can be employed with excellent results for both organic and inorganic electrophotographic imaging members. The addition of solvents or diluents also seems to minimize microgel formation. If desired, solvents such as 2-methoxyethanol may be added to the coating mixture to control the evaporation rate during the coating operation.

If necessary, a primer coating may be applied to the electrophotographic imaging member to improve adhesion of the cross-linked siloxanol-colloidal silica hybrid material to the electrophotographic imaging member. Typical primer coating materials inlcude, for example, polyesters (e.g. Vitel PE-100, Commerically available from Goodyear Tire & Rubber Co.), polymethylmethactylate, poly(carbonate-co-ester) (e.g. GE 3250, available from General Electric Co.), polycarbonates, and the like and mixtures thereof. A primer coating of polyester (Vitel PE-200) and polymethylmethactylate having a weight ratio of about 80:20 is preferred for selenium and selenium alloy electrophotographic imaging members because of the adhesion and protection achieved. An alcohol soluble polymethacrylate may, for example be employed as an adhesion layer between a conductive layer and a charge generator layer of multi-layered photoresponsive devices.

Any suitable electrophotographic imaging member may be coated with the process of the invention. The electrophotographic imaging members may contain inorganic or organic photoresponsive materials in one or more layers. Typical photoresponsive materials include selenium, selenium alloys, such as arsenic selenium and tellurium selenium alloys, halogen doped selenium, and halogen doped selenium alloys. Typical multi-layered photoresponsive devices include those described in U.S. Pat. No. 4,251,612, which device comprising an electrically conductive substrate, overcoated with a layer capable of injecting holes into a layer on its surface, this layer comprising carbon black or graphite dispersed in the polymer, a hole transport layer in operative contact with the laye of hole injecting material, overcoated with a layer of charge generating material comprising inorganic or organic photoconductive materials, this layer being in contact with a charge transport layer, and a top layer of an insulating organic resin overlying the layer of charge generating layer. Other organic photoresponsive devices embraced within the scope of the present invention include those comprising a substrate, a generating layer such as trigonal selenium or vanadyl phthalocyanine in a binder, and a transport layer such as those described in U.S. Pat. No. 4,265,990. Still other organic photoresponsive devices include those comprising a substrate, a transport layer, and a generating layer.

The electrophotographic imaging member may be of any suitable configuration. Typical configurations include sheets, webs, flexible or rigid cylinders, and the like. Generally, the electrophotographic imaging members comprise a supporting substrate which may be electrically insulating, electrically conductive, opaque or substantially transparent. If the substrate is electrically insulating, an electrically conductive layer is usually applied to the substrate. The conductive substrate or conductive layer may comprise any suitable material such as aluminum, nickel, brass, conductive particles in a binder, and the like. For flexible substrates, one may utilize any suitable conventional substrate such as aluminized Mylar. Depending upon the degree of flexibility desired, the substrate layer may be of any desired thickness. A typical thickness for a flexible substrate is from about 3 mils to about 10 mils.

Generally, electrophotographic imaging members comprise one or more additional layers on the conductive substrate or conductive layer. For example, depending upon flexibility requirements and adhesive properties of subsequent layers, one may utilize an adhesive layer. Adhesive layers are well known and examples of typical adhesive layers are described in U.S. Pat. No. 4,265,990.

One or more additional layers may be applied to the conductive or adhesive layer. When one desires a hole injecting conductive layer coated on a substrate, any suitable material capable of injecting charge carriers under the influence of an electric field may be utilized. Typical of such materials include gold, graphite or carbon black. Generally, the carbon black or graphite dispersed in the resin are employed. This conductive layer may be prepared, for example, by solution casting of a mixture of carbon black or graphite dispersed in an adhesive polymer solution onto a support substrate such as Mylar or aluminized Mylar. Typical examples of resins for dispsersing carbon black or graphite include polyesters such as PE 100 commercially available from Goodyear Tire & Rubber Company, polymeric esterification products of a dicarboxylic acid and a diol comprising a diphenol, such as 2,2-bis(3-beta hydroxy ethoxy phenyl) propane, 2,2-bis(4-hydroxyisopropoxyphenyl)propane, 2,2-bis(4-beta hydroxy ethoxy phenyl)pentane and the like and a dicarboxylic acid such as oxalic acid, malonic acid, succinic acid, phthalic acid, terephthalic acid, and the like. The weight ratio of polymer to carbon black or graphite may range from about 0.5:1 to 2:1 with the preferred range being about 6:5. The hole injecting layer may have a thickness in the range of from about 1 micron to about 20 micrometers, and preferably from about 4 micrometers to about 10 micrometers.

A charge carrier transport layer may be overcoated on the hole injecting layer and may be selected from numerous suitable materials capable of transporting holes. The charge transport layer generally has a thickness in the range of from about 5 to about 50 micrometers and preferably from about 20 to about 40 micrometers. A charge carrier transport layer preferably comprises molecules of the formula:

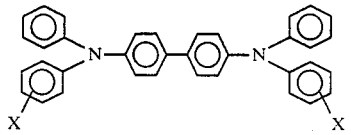

dispersed in a highly insulating and transparent organic resinous material wherein X is selected from the group consisting of (ortho)$CH_3$,(meta)$CH_3$, (para)$CH_3$,(ortho)Cl, (meta)Cl, and (para)Cl. The charge transport layer is substantially non-absorbing in the spectral region of intended use, e.g., visible light, but is "active" in that it allows injection of photogenerated holes from the charge generator layer and electrically induced holes from the injecting surface. A highly insulating resin, having a resistivity of at least about $10^{12}$ ohm-cm to prevent undue dark decay will not necessarily be capable of supporting the injection of holes from the injecting generating layer and is not normally capable of allowing the transport of these holes through the resin. However, the resin becomes electrically active when it contains from about 10 to about 75 weight percent of, for example, N,N,N',N'-tetraphenyl-[1,1'-biphenyl]-4,4'-diamine corresponding to the structual formula above. Other materials corresponding to this formula include, for examples, N,N'-diphenyl-N,N'-bis-(alkylphenyl)-[1,1'-biphenyl]-4,4'-diamine wherein the alkyl group is selected from the group consisting of methyl such as 2-methyl, 3-methyl and 4-methyl, ethyl, propyl, butyl, hexyl, and the like. In the case of chloro substitution, the compound may be N,N'-diphenyl-N,N'-bis(halophenyl)-[1,1'-biphenyl]-4,4'-diamine wherein the halo atom is 2-chloro, 3-chloro or 4-chloro.

Other electrically active small molecules which can be dispersed in the electrically inactive resin to form a layer which will transport holes includes triphenylmethane, bis(4-diethylamino-2-methylphenyl)-phenylmethane, 4',4''-bis(diethylamino)-2',2''-dimethyltriphenylmethane, bis4(diethylaminophenyl)phenylmethane, and 4,4'-bis(diethylamino)-2',2''-dimethyltriphenylmethane.

The generating layer that may be utilized, in addition to those disclosed herein, can include, for example, pyrylium dyes, and numerous other photoconductive charge carrier generating materials provided that these materials are electrically compatible with the charge carrier transport layer, that is, they can inject photoexcited charge carriers into the transport layer and the charge carriers can travel in both directions across the interface between the two layers. Particularly useful inorganic photoconductive charge generating material include amorphous selenium, trigonal selenium, selenium-arsenic alloys and selenium-tellurium alloys and organic charge carrier generating materials including the X-form of phthalocyanine, metal phthalocyanines and vanadyl phthalocyanines. These materials can be used alone or as a dispersion in a polymeric binder. This layer is typically from about 0.5 to about 10 micrometres or more in thickness. Generally, the thickness of the layer should be sufficient to absorb at least about 90 percent or more of the incident radiation which is directed upon it in the imagewise exposure step. The maximum thickness is dependent primarily upon mechanical considerations such as whether a flexible photoreceptor is desired.

The electrophotographic imaging member can be imaged by the conventional steps of uniformly depositing an electrostatic charge and exposing to an imagewise pattern of electromagnetic radiation to which the charge carrier generating layer is responsive to form an electrostatic latent image on the electrophotographic imaging member. The electrostatic latent image formed may then be developed by conventional means resulting in a visible image. Conventional development techniques such as cascade development, magnetic brush development, liquid development, and the like may be utilized. The visible image is typically transferred to a receiving member by conventional transfer techniques and permanently affixed to the receiving member.

The polymerizable silane materials containing the electron-accepting groups attached to silicon of the present invention can also be used as overcoatings for three layered organic electrophotographic imaging members as indicated hereinabove and in the Examples below. For example, in U.S. Pat. No. 4,265,990, an electrophotographic imaging device is described which comprises a substrate, a generating layer, and a transport layer. Examples of generating layers include trigonal selenium and vanadyl phthalocyanine. Examples of transport layers include various diamines dispersed in a polymer as disclosed hereinabove and in the Examples below.

The polymerizable silane materials containing the electron accepting groups attached to silicon of the instant invention are soluble in solvents such as alcohol and thus can be conveniently coated from alcoholic solutions. However, once the polymerizable silane material containing the electron accepting groups attached to silicon is cross-linked into its resinous state, it is no longer soluble and can withstand cleaning solutions such as ethanol and isopropanol. Additionally, because of their excellent transfer, solvent stability and cleaning characteristics, the overcoated electrophotographic imaging devices of the present invention may be utilized in liquid development systems.

The invention will now be described in detail with respect to specific preferred embodiments thereof, it being understood that these embodiments are intended to be illustrative only and that the invention is not intended to be limited to the specific materials, conditions, process parameters and the like recited herein. Parts and percentages are by weight unless otherwise indicated.

EXAMPLE I

A photoreceptor was prepared comprising a cylindrical aluminum substrate having a diameter of about 8.3 centimeters and a length of about 33 centimeters coated with a vacuum deposited first layer having a thickness of about 55 micrometers and containing about 99.5 percent by weight selenium, about 0.5 percent by weight arsenic and about 20 parts per million chlorine and a vacuum deposited second outer layer having a thickness of about 5 micrometers and containing about 90 percent by weight selenium and about 10 percent by weight tellurium. A primer containing a 0.05 percent solution of an 80:20 weight ratio of polyester (PE-200 Vitel, available from Goodyear Tire and Rubber Co.)-/polymethyl methacrylate in a 1:1 volume ratio of $CH_2Cl_2/Cl_2CHCH_2Cl$ was applied by dip-coating in a cylindrical glass vessel. The flow time was about 8–10 seconds. The drum was then air-dried to form a coating having a thickness of less than about 0.03–0.05 micrometer. An overcoating solution was prepared by blending in a plastic bottle a mixture of 4.8 grams of triethoxysilane $[HSi(OC_2H_5)_3]$, 7.2 grams of chloromethyl triethoxysilane $[ClCH_2Si(OC_2H5)_3]$, 128 grams of isopropanol, 58.5 grams of isobutanol and 1.5 grams of water. The mixture was allowed to cohydrolyze in the bottle for about 30–60 minutes at ambient temperature and thereafter filtered through a #2 Whatman Paper. The cohydrolyzed solution was applied by spraying on to one half of the area along the axial length of the cylinder surface, the other half being coated only by the previously deposited primer. The solution was applied to half of the cylinder surface by means of Binks spray equipment under controlled temperature and humidity conditions of 20° C. and 40 percent relative humidity. The final overcoating thickness was controlled by the number of spray passes. After the final spray pass, the overcoating film was air dried and then cured for 30 minutes at about 50° C. in a forced-air oven. The cured film thickness was estimated to be 0.5 to 0.6 micrometers thick as determined by a Nikon interference microscopic examination of an aluminized Mylar mask (protecting the uncoated half of the primed drum) which was sprayed at the same time as the unprotected half of the primed drum. the nonovercoated primed area of the cylinder was solvent cleaned of primer to expose the alloy photoreceptor surface. Electrical scanning of the photoreceptor at ambient conditions of 20° C. and 40 percent relative humidty indicated no essential difference in residual voltage between the overcoated side and the nonovercoated halves of the drum. This overcoated photoreceptor was cycled in a Xerox 2830 electrophotographic copier through conventional xerographic imaging steps comprising uniform charging, exposure to a test pattern to form an electrostatic latent image corresponding to the test pattern, development with a magnetic brush developer applicator to form a toner image corresponding to the electrostatic latent image, electrostatically transferring the toner image to a sheet of paper and cleaning the overcoated photoreceptor. The cycling was first conducted in a controlled environment in which the temperature was maintained at 22.2° C. and the relative humidty maintained at 60 percent. Examination of the transferred toner images cycles revealed excellent print quality and no observable background on either section of the photoreceptor after a 400 copy run. Cycling was then conducted in a controlled environment in which the temperature was maintained at 21.1° C. and the relative humidity maintained at 10 percent. Examination of the transferred toner images after a 300 copy run revealed excellent print quality and no observable background on either section of the photoreceptor.

EXAMPLE II

A photoreceptor was prepared comprising a cylindrical aluminum substrate having a diameter of about 8.3 centimeters and a length of about 33 centimeters coated with a vacuum deposited first layer having a thickness of about 55 micrometers and containing about 99.5 percent by weight selenium, about 0.5 percent by weight arsenic and about 20 parts per million chlorine and a vacuum deposited second outer layer having a thickness of about 5 micrometers and containing about 90 percent by weight selenium and about 10 percent by weight tellurium. A primer containing a 0.05 percent solution of an 80:20 weight ratio of polyester (PE-200 Vitel, available from Goodyear Tire and Rubber Co.)-/polymethyl methacrylate in a 1:1 volume ratio of $CH_2Cl_2/Cl_2CHCH_2Cl$ was applied by dip-coating in a cylindrical glass vessel. The flow time was about 8–10 seconds. The drum was then air-dried to form a coating having a thickness of less than about 0.03–0.05 micrometer. An overcoating solution was prepared by blending in a plastic bottle a mixture of 18 grams of cross-linkable siloxanol-colloidal silica hybrid material (20 percent solids available from Dow Corning Co., containing no ionic contamination and having an acid number less than about 1), 118 grams of isopropanol, 3 grams of chloromethyl triethoxysilane [$ClCH_2Si(OC_2H5)_3$], 59 grams of isobutanol, 0.7 gram of Petrarch fluid (PSX464, available from Petrarch Systems, Inc.), 0.3 gram of aminosilane catalyst (A-1100, available from Union Carbide Corp.) and 1 gram of water. The mixture was allowed to cohydrolyze in the bottle for about 30 minutes at ambient temperature and thereafter filtered through a #2 Whatman Paper. The cohydrolyzed solution was applied by spraying on to one half of the area along the axial length of the cylinder surface, the other half being coated only by the previously deposited primer. The solution was applied to half of the cylinder surface by means of Binks spray equipment under controlled temperature and humidity conditions of 20° C. and 40 percent relative humidity. The final overcoating thickness was controlled by the number of spray passes. After the final spray pass, the overcoating film was air dried and then cured for 30 minutes at about 50° C. in a forced-air oven. The cured film thickness was estimated to be 0.5 to 0.6 micrometers thick as determined by a Nikon interference microscopic examination of an aluminized Mylar mask (protecting the uncoated half of the primed drum) which was sprayed at the same time as the unprotected half of the primed drum. The nonovercoated primed area of the cylinder was solvent cleaned of primer to expose the alloy photoreceptor surface. Electrical scanning of the photoreceptor at ambient conditions of 21° C. and 44 percent relative humidity indicated no essential difference in residual voltage between the overcoated side and the nonovercoated halves of the drum. This overcoated photoreceptor was cycled in a Xerox 2830 electrophotographic copier through conventional xerographic imaging steps comprising uniform charging, exposure to a test pattern to form an electrostatic latent image corresponding to the test pattern, development with a magnetic brush developer applicator to form a toner image corresponding to the electrostatic latent image, electrostaticlly transferring the toner image to a sheet of paper and cleaning the overcoated photoreceptor. The cycling was first conducted in a controlled environment in which the temperature was maintained at 22.8° C. and the relative humidty maintained at 44 percent. Examination of the transferred toner images revealed excellent print quality and no background on either section of the photoreceptor after a 200 copy run. Cycling was then conducted in a controlled environment in which the temperature was maintained at 21.1° C. and the relative humidity maintained at 10 percent. Examination of the transferred toner images after a 200 copy run revealed excellent print quality and low background on either section of the photoreceptor.

EXAMPLE III

A photoreceptor was prepared comprising a cylindrical aluminum substrate having a diameter of about 8.3 centimeters and a length of about 33 centimeters coated with a vacuum deposited first layer having a thickness of about 55 micrometers and containing about 99.5 percent by weight selenium, about 0.5 percent by weight arsenic and about 20 parts per million chlorine and a vacuum deposited second outer layer having a thickness of about 5 micrometers and containing about 90 percent by weight selenium and about 10 percent by weight tellurium. A primer containing a 0.05 percent solution of an 80:20 weight ratio of polyester (PE-200 Vitel, available from Goodyear Tire and Rubber Co.)-/polymethyl methacrylate in a 1:1 volume ratio of $CH_2Cl_2/Cl_2CHCH_2Cl$ was applied by dip-coating in a cylindrical glass vessel. The flow time was about 8–10 seconds. The drum was then air-dried to form a coating having a thickness of less than about 0.03–0.05 micrometer. An overcoating solution was prepared by blending in a plastic bottle a mixture of 12.0 grams of 2-cyanoethyltriethoxysilane, 8.0 grams of triethoxysilane [$HSi(OC_2H_5)_3$], 124.6 grams of isopropanol, and 5.4 grams of water. The mixture was allowed to cohydrolyze in the bottle for about 60 minutes at ambient temperature and thereafter filtered through a #2 Whatman Paper. The cohydrolyzed solution was applied by spraying on to one half of the area along the axial length of the cylinder surface, the other half being coated only by the previously deposited primer. The solution was applied to half of the cylinder surface by means of Binks spray equipment under controlled temperature and humidity conditions of 18° C. and 30 percent relative humidity. The final overcoating thickness was controlled by the number of spray passes. After the final spray pass, the overcoating film was air dried and then cured for 60 minutes at about 50° C. in a forced-air oven. The cured film thicknes was estimated to be 0.8 to 1.0 micrometers thick as determined by a Nikon interference microscopic examination of an aluminized Mylar mask (protecting the uncoated half of the primed drum) which was sprayed at the same time as the unprotected half of the primed drum. The nonovercoated primed area of the cylinder was solvent cleaned of primer to exposed the alloy photoreceptor surface. Electrical scanning of the photoreceptor at ambient conditions of 20° C. and 40 percent relative humidity indicted no essential difference in residual voltage between the overcoated side and the nonovercoated halves of the drum. This overcoated photoreceptor was cycled in a Xerox 2830 electrophotographic copier through conventional xerographic imaging steps comprising uniform charging, exposure to a test pattern to form an electrostatic latent image corresponding to the test pattern, development with a magnetic brush developer applicator to form a toner image corresponding to the electrostatic latent image, electrostatically transferring the toner image to a sheet of paper and cleaning the overcoated photoreceptor. The cylcing was first conducted in a controlled environment in which the temperature was maintained at 20° C. and the relative humidity maintained at 40 percent. Examination of the transferred toner images cycles revealed excellent print quality and no observable background on either section of the photoreceptor after a 400 copy run. Cycling was then conducted in a controlled environment in which the temperature was maintained at 18° C. and the relative humidity maintained at 12 percent. Examination of the transferred toner images after a 400 copy run revealed excellent print quality and no observable background on either section of the photoreceptor.

EXAMPLE IV

A photoreceptor was prepared comprising a cylindrical aluminum substrate having a diameter of about 8.3 centimeters and a length of about 33 centimeters coated with a vacuum deposited first layer having a thickness of about 55 micrometers and containing about 99.5 percent by weight selenium, about 0.5 percent by weight arsenic and about 20 parts per million chlorine and a vacuum deposited second outer layer having a thickness of about 5 micrometers and containing about 90 percent by weight selenium and about 10 percent by weight tellurium. A primer containing a 0.05 percent solution of an 80:20 weight ratio of polyester (PE-200 Vitel, available from Goodyear Tire and Rubber Co.)-/polymethyl methacrylate in a 1:1 volume ratio of $CH_2Cl_2/Cl_2CHCH_2Cl$ was applied by dip-coating in a cylindrical glass vessel. The flow time was about 8–10 seconds. The drum was then air-dried to form a coating having a thickness of less than about 0.03–0.05 micrometer. An overcoating solution was prepared by blending in a plastic bottle a mixture of 20 grams of cross-linkable siloxanol-colloidal silica hybrid material (20 percent solids available from Dow Corning Co., containing no ionic contamination and having an acid number less than about 1), 16.0 grams of 2-cyanoethyltriethoxysilane, 223.5 grams of isopropanol, 137.3 grams of isobutanol, 1.3 gram of Petrarch fluid (PSX464, available from Petrarch Systems, Inc.), 0.5 gram of aminosilane catalyst (A-1100, available from Union Carbide Corp.), and 1.4 grams of water. The mixture was allowed to cohydrolyze in the bottle for about 30 minutes at ambient temperature and thereafter filtered through a #2 Whatman Paper. The cohydrolyzed solution was applied by spraying on to one half of the area along the axial length of the cylinder surface, the other half being coated only by the previously deposited primer. The solution was applied to half of the cylinder surface by means of Binks spray equipment under controlled temperature and humidity conditions of 19° C. and 32 percent relative humidity. The final overcoating thickness was controlled by the number of spray passes. After the final spray pass, the overcoating film was air dried and then cured for 90 minutes at about 50° C. in a forced-air oven. The cured film thickness was estimated to be 0.7 to 1.0 micrometers thick as determined by a Nikon interference microscopic examination of an aluminized Mylar mask (protecting the uncoated half of the primed drum) which was sprayed at the same time as the unprotected half of the primed drum. The nonovercoated primed area of the cylinder was solvent cleaned of primer to expose the alloy photoreceptor surface. Electrical scanning of the photoreceptor at ambient conditions of 20° C. and 40 percent relative humidity indicated no essential difference in residual voltage between the overcoated side and the nonovercoated halves of the drum. This overcoated photoreceptor was cycled in a Xerox 2830 electrophotographic copier through conventional xerographic imaging steps comprising uniform charging, exposure to a test pattern to form an electrostatic latent image corresponding to the test pattern, development with a magnetic brush developer applicator to form a toner image corresponding to the electrostatic latent image, electrostatically transferring the toner image to a sheet of paper and cleaning the overcoated photoreceptor. The cycling was first conducted in a controlled environment in which the temperature was maintained at 20° C. and the relative humidity maintained at 40 percent. Examination of the transferred toner images cycles revealed excellent print quality and no observable background on either section of the photoreceptor after a 400 copy run. Cycling was then conducted in a controlled environment in which the temperature was maintained at 26° C. and the relative humidity maintained at 80 percent. Examination of the transferred toner images after a 400 copy run revealed excellent print quality and no observable background on either section of the photoreceptor.

EXAMPLE V

A photoreceptor comprising a cylindrical aluminum substrate having a diameter of about 8 centimeters and a length of about 26 centimeters coated with a transport layer having a thickness of about 15 micrometers and containing about 50 percent by weight based on the total weight of the layer of N,N',-diphenyl-N,N'-bis(-methylphenyl)-[1,1'-biphenyl]-diamine dispersed in polycarbonate resin and a photogenerator layer having a thickness of about 0.8 mcrometer containing a phthalocyanine pigment dispersed in polyester (Vitel PE-100, available from Goodyear Tire and Rubber Co.) was coated with an overcoating solution. The overcoating solution was prepared by blending in a plastic bottle a mixture of 4.8 grams of triethoxysilane $[HSi(OC_2H_5)_3]$, 7.2 grams of chloromethyl triethoxysilane $[ClCH_2Si(OC_2H5)_3]$, 128 grams of isopropanol, 58.5 grams of isobutanol, and 1.5 grams of water. The mixture was allowed to cohydrolyze in the bottle for about 60 minutes at ambient temperature and thereafter filtered through a #2 Whatman Paper. The solution was applied to half of the cylinder surface by means of Binks spray equipment under controlled temperature and humidity conditions of 21° C. and 35 percent relative humidity. The final overcoating thickness was controlled by the number of spray passes. After the final spray pass, the overcoating film was air dried and then cured for 30 minutes—at about 125° C. in a forced-air oven. The cured solid polymer coating had a thickness of about 1 micrometer and could not be scratched with a sharpened 5H pencil. This overcoated photoreceptor was cycled through conventional xerographic imaging steps comprising uniform charging, exposure to a test pattern to form an electrostatic latent image corresponding to the test pattern, development with a magnetic brush developer applicator to form a toner image corresponding to the electrostatic laten image, electrostatically transferring the toner image to a sheet of paper and cleaning the overcoated photoreceptor. The cycling was first conducted in a controlled environment in which the temperature was maintained at 20° C. and the relative humidity maintained at 40 percent. Examination of the transferred toner images after 400 cycles revealed excellent print quality and no observable background on either section of the photoreceptor. Cycling was then conducted in a controlled environment in which the temperature was maintained at 26° C. and the relative humidity maintained at 80 percent. Examination of the transferred toner images after 400 cycles revealed excellent print quality and no observable background on either section of the photoreceptor.

EXAMPLE VI

A photoreceptor comprising a cylindrical aluminum substrate having a diameter of about 8 centimeters and a length of about 26 centimeters coated with a transport layer having a thickness of about 15 micrometers and containing about 50 percent by weight based on the total weight of the layer of N,N',-diphenyl-N,N'-bis(-methylphenyl)-[1,1'-biphenyl]-diamine dispersed in polycarbonate resin and a photogenerator layer having a thickness of about 0.8 micrometer containing a phthalocyanine pigment dispersed in polyester (Vitel PE-100, available from Goodyear Tire and Rubber Co.) was coated with an overcoating solution. The overcoating solution was prepared by blending in a plastic bottle a mixture of 18 grams of cross-linkable siloxanol-colloidal silica hybrid material (20 percent solids available from Dow Corning Co., containing no ionic contamination and having an acid number less than about 1), 3 grams of chloromethyl triethoxysilane [$ClCH_3Si(OC_2H_5)_3$], 118 grams of isopropanol, 59 grams of isobutanol, 0.7 gram of Petrarch fluid (PSX464, available from Petrarach Systems, Inc.), 0.3 gram of aminosilane catalyst (A-1100, available from Union Carbide Corp.), and 1 gram of water. The mixture was allowed to cohydrolyze in the bottle for about 30 minutes at ambient temperature and thereafter filtered through a #2 Whatman Paper. The solution was applied to half of the cylinder surface by means of Binks spray equipment under controlled temperature and humidity conditions of 19° C. and 37 percent relative humidity. The final overcoating thickness was controlled by the number of spray passes. After the final spray pass, the overcoating film was air dried and then cured for 1 hour at about 125° C. in a forced-air oven. The cured solid polymer coating had a thickness of about 1 micrometer and could not be scratched with a sharpened 5H pencil. This overcoated photoreceptor was cycled through conventional xerographic imaging steps comprising uniform charging, exposure to a test pattern to form an electrostatic latent image corresponding to the test pattern, development with a magnetic brush developer applicator to form a toner image corresponding to the electrostatic latent image, electrostatically transferring the toner image to a sheet of paper and cleaning the overcoated photoreceptor. The cycling was first conducted in a controlled environment in which the temperature was maintained at 20° C. and the relative humidity maintained at 40 percent. Examination of the transferred toner images after 400 cycles revealed excellent print quality and no observable background on either section of the photoreceptor. Cycling was then conducted in a controlled environment in which the temperature was maintained at 26° C. and the relative humidity maintained at 80 percent. Examination of the transferred toner images after 400 cycles revealed excellent print quality and no observable background on either section of the photoreceptor.

The invention has been described in detail with particular reference to preferred embodiments thereof and it will be understood that variations and modifications can be effected within the spirit and scope of the invention as described hereinabove, and as defined in the appended claims.

What is claimed is:

1. An electrophotographic imaging member comprising a supporting substrate, at least one photoconductive layer and an overcoating layer comprising a polymerized silane, said polymerized silane comprising a reaction product of a hydrolyzed alkoxy silane, said alkoxy silane having the following structual formula:

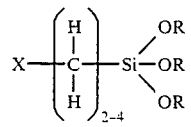

wherein R is an alkyl group having from 1 to 4 carbon atoms and X is an electron accepting atom or an electron attracting moiety.

2. An electrophotographic imaging member according to claim 1 wherein said polymerized silane comprises a reaction product of said hydrolyzed alkoxy silane and a cross-linkable siloxanol-colloidal silica hybrid material having at least one silicon bonded hydroxyl group per every three —SiO— units.

3. An electrophotographic imaging member according to claim 2 wherein said cross-linkable siloxanol-colloidal silical hybrid material has an acid number of less than about 1.

4. An electrophotographic imaging member according to claim 1 wherein said overcoating layer has a thickness of between about 0.3 micrometer and about 3 micrometers.

5. An electrophotographic imaging member according to claim 1 wherein said overcoating layer includes a plasticizer for said polymerized silane.

6. An electrophotographic imaging member according to claim 1 wherein said overcoating layer overlies a primer coating layer.

7. An electrophotographic imaging member according to claim 1 wherein said overcoating is applied to an amorphous selenium layer of an electrophotographic imaging member.

8. An electrophotographic imaging member according to claim 1 wherein said overcoating layer overlies a selenium alloy layer of an electrophotographic imaging member.

9. An electrophotographic imaging member according to claim 1 wherein said overcoating layer overlies a charge generating layer of an electrophotographic imaging member.

10. An electrophotographic imaging member according to claim 1 wherein said overcoating layer overlies a charge transport layer of an electrophotographic imaging member.

11. An electrophotographic imaging member according to claim 10 wherein said charge transport layer comprises a diamine dispersed in a polycarbonate resin, said diamine having the formula:

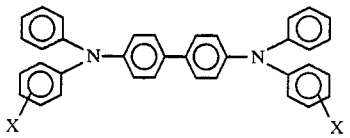

wherein X is selected from the group consisting of $CH_3$ and Cl.

12. An electrophotographic imaging member according to claim 1 wherein said overcoating layer comprises from about 20 percent by weight to about 90 percent by weight segments from said alkoxy silane, based on the total weight of said overcoating layer.

13. An electrophotographic imaging member according to claim 1 wherein said overcoating layer comprises from about 40 percent by weight to about 70 percent by weight segments from said alkoxy silane, based on the total weight of said overcoating layer.

14. An electrophotographic imaging member according to claim 1 wherein said polymerized silane is cross-linked.

* * * * *